US009876279B2

(12) United States Patent
Crouch et al.

(10) Patent No.: US 9,876,279 B2
(45) Date of Patent: Jan. 23, 2018

(54) MONOLITHIC WIDEBAND MILLIMETER-WAVE RADOME

(71) Applicant: Raytheon Company, Waltham, MA (US)

(72) Inventors: David D. Crouch, Corona, CA (US); David R. Sar, Corona, CA (US)

(73) Assignee: RAYTHEON COMPANY, Waltham, MA (US)

( * ) Notice: Subject to any disclaimer, the term of this patent is extended or adjusted under 35 U.S.C. 154(b) by 12 days.

(21) Appl. No.: 14/928,143

(22) Filed: Oct. 30, 2015

(65) Prior Publication Data

US 2017/0125896 A1 May 4, 2017

(51) Int. Cl.
*H01Q 1/42* (2006.01)

(52) U.S. Cl.
CPC ..... *H01Q 1/422* (2013.01)

(58) Field of Classification Search
CPC ..... H01Q 1/42
USPC ..... 343/872
See application file for complete search history.

(56) References Cited

U.S. PATENT DOCUMENTS 3,432,859 A * 3/1969 Plant ..... H01Q 1/422 156/205
3,780,374 A 12/1973 Shibano et al.
3,806,928 A * 4/1974 Costanza ..... H01Q 17/00 156/297
3,871,001 A 3/1975 Myers
4,506,269 A * 3/1985 Greene ..... H01Q 1/424 343/872
4,980,696 A 12/1990 Stone et al.
5,408,244 A 4/1995 MacKenzie
5,528,249 A * 6/1996 Gafford ..... H01Q 1/425 343/700 MS
7,463,212 B1 * 12/2008 Ziolkowski ..... H01Q 1/42 343/872
7,710,347 B2 5/2010 Gentilman
8,081,137 B2 * 12/2011 Chang ..... H01Q 1/421 343/872
8,698,691 B2 * 4/2014 Chen ..... H01Q 1/002 165/104.33
9,099,782 B2 * 8/2015 Ziolkowski ..... H01Q 1/424
2009/0096687 A1 4/2009 Gentilman et al.
2010/0206523 A1 8/2010 Chen et al.

OTHER PUBLICATIONS

ISR/WO, dated Nov. 8, 2016, RAY0320PCT, PCT Application No. PCT/US16/48543, 13 pages.

* cited by examiner

*Primary Examiner* — Huedung Mancuso
(74) *Attorney, Agent, or Firm* — Cantor Colburn LLP

(57) ABSTRACT

A monolithic, wideband, millimeter-wave radome is provided. The radome includes a solid layer formed of a single material and a lattice layer formed of the single material and disposed on an exterior surface of the solid layer. The lattice layer includes void regions formed from selective omission of the single material during lattice layer buildup.

20 Claims, 9 Drawing Sheets

MONOLITHIC WIDEBAND MILLIMETER-WAVE RADOME

BACKGROUND

The present invention relates to electromagnetic radomes and, more specifically, to wideband radomes for use at radio frequencies (RF) as well as microwave and millimeter-wave frequencies.

A radome is a structural enclosure that protects an antenna. Radomes are typically constructed of material that minimally attenuates the electromagnetic (EM) signal transmitted or received by the antenna. In other words, the radome is transparent to radar or radio waves. Radomes also protect the antenna surfaces from weather and conceal antenna electronic equipment from public view. Radomes can be constructed in several shapes (spherical, geodesic, planar, etc.) depending upon the particular application using various construction materials (fiberglass, PTFE-coated fabric, etc.). When provided on found on fixed-wing aircraft with forward-looking radar, radomes may be provided as nose cone sections of the fuselage.

A simple radome structure may be a uniform slab of material of thickness $n\lambda/2$ (where n is an integer) and $\lambda=\lambda_{vac}/\sqrt{(\in_R)}$.

Such radomes perform well at a single frequency, but are narrowband unless $\in_R \approx 1$ and fragile at millimeter-wave frequencies if n=1. Wideband performance typically requires a multilayer structure in which the dielectric constant and thickness of each layer are chosen to optimize performance. Examples of multilayer radome structures include, but are not limited to, A-sandwich structures where a low dielectric layer is sandwiched between two high dielectric layers and B-sandwich structures where a high dielectric layer is sandwiched between two low-dielectric layers.

SUMMARY

According to one embodiment of the present invention, a monolithic, wideband, millimeter-wave radome is provided. The radome includes a solid layer formed of a single material and a single lattice layer formed of the single material and disposed on an exterior surface of the solid layer. The lattice layer includes void regions formed from selective omission of the single material during latticelayer buildup.

According to another embodiment, a monolithic, wideband, millimeter-wave radome is provided and includes multiple solid layers formed of a single material and multiple lattice layers formed of the single material and disposed on respective exterior surfaces of corresponding ones of the multiple solid layers. Each of the multiple lattice layers includes void regions formed from selective omission of the single material during lattice layer buildups.

According to another embodiment, a monolithic, wideband, millimeter-wave radome fabrication method is provided. The method includes laying down a single material in a layer-by-layer and side-to-side pattern to form a solid layer and laying down the single material in a layer-by-layer and side-to-side pattern to form a lattice layer on an exterior surface of the solid layer. The laying down of the single material to form the lattice layer includes selectively omitting the single material during buildup of the lattice layer to develop void regions therein.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Conventional radome fabrication approaches become difficult to apply at millimeter-wave frequencies because tolerance requirements become increasingly difficult to meet as the effective wavelength of the electromagnetic (EM) radiation passing through radomes decreases. Additive manufacturing, however, with its ability to build three-dimensional structures at low cost via precise sequential deposition of material, offers a solution and opens a realm of new possibilities in radome design.

Figure 1:
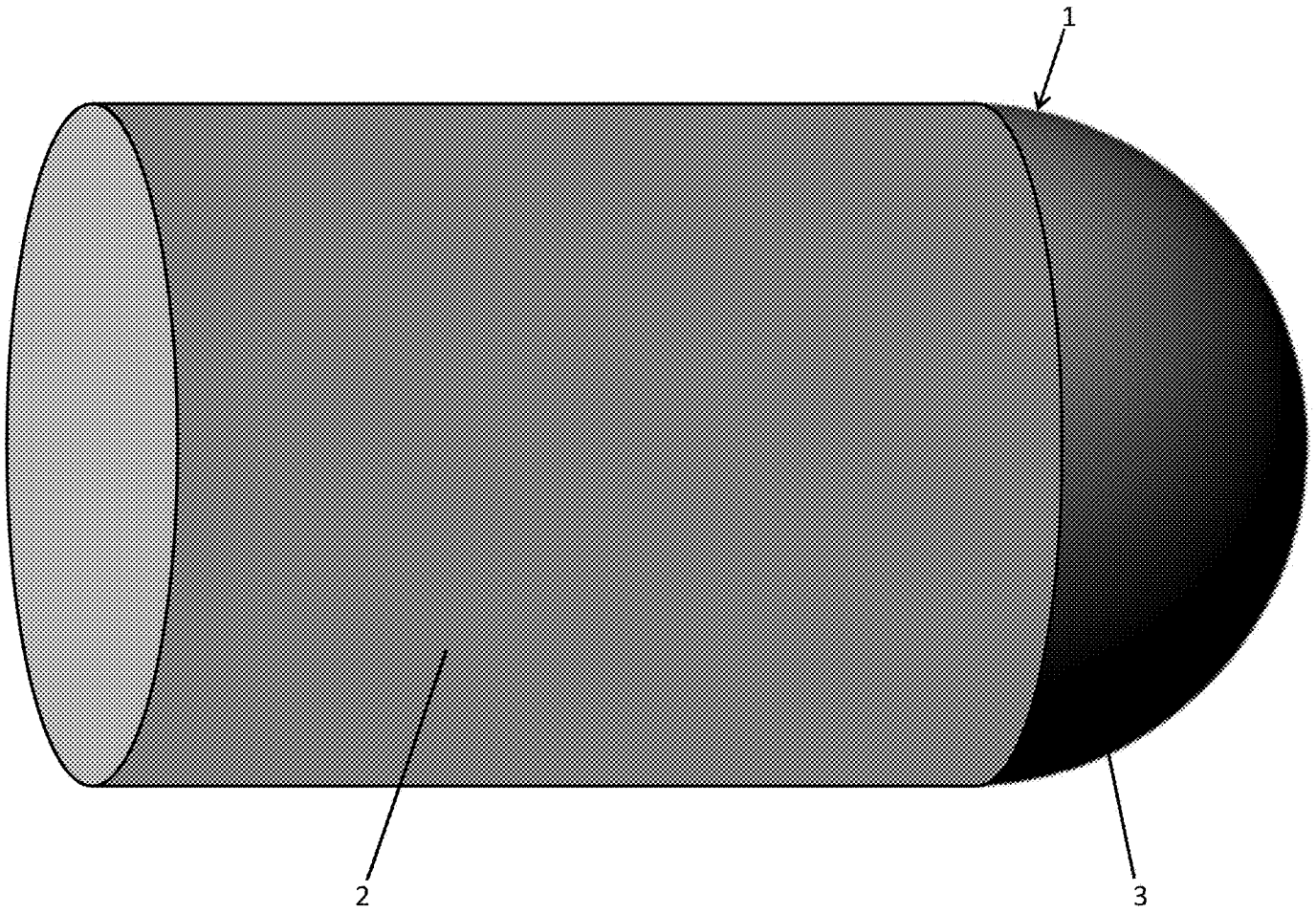
FIG. 1 is a side schematic illustration of a radome in accordance with embodiments.

For example, with reference to FIG. 1, additive manufacturing can be employed to form a hemispherical radome 1. This radome 1 may be designed to operate over the 71-86 GHz band with minimal loss and is formed from at least one of Polyether Ether Ketone (PEEK), Polyether Ketone Ketone (PEKK), acrylonitrile butadiene styrene, Nylon and Ultem 9085 (polyetherimide) via at least one of fused deposition modeling (FDM), selective laser sintering (SLS) and stereolithography (SLA). It is provided as a simple half-wavelength design having a wall thickness of 43.5 mils ($\lambda/2$ at the 78 GHz mid-band frequency) and may be fabricated to a tolerance of ±3 mils. Insertion loss, as measured in the field, can be as little as 0.2 dB in a worst case scenario. The radome 1 includes a substantially cylindrical sidewall 2 and a semi-spherical section 3 and can be disposed for use in a forward end of an aircraft or missile to permit EM radiation passage through either or both of the cylindrical sidewall 2 and the semi-spherical section 3.

While the radome 1 performs well and demonstrates the potential of additive manufacturing for radome applications, its mechanical strength can be increased. One way to increase the mechanical strength is by increasing the thickness of the radome 1 material at either the cylindrical sidewall 2 or the semi-spherical section 3. Doing so will allow for insertion loss to remain small near the center of the design band as long as the thickness of the radome 1 is an integral number of half-wavelengths but it is to be understood that a consequence of increased radome 1 thickness is decreased bandwidth. Thus, an alternate option for increasing a strength characteristic of a given radome without sacrificing bandwidth or electrical performance relies on the formation of a multilayer radome structure.

Figure 2:
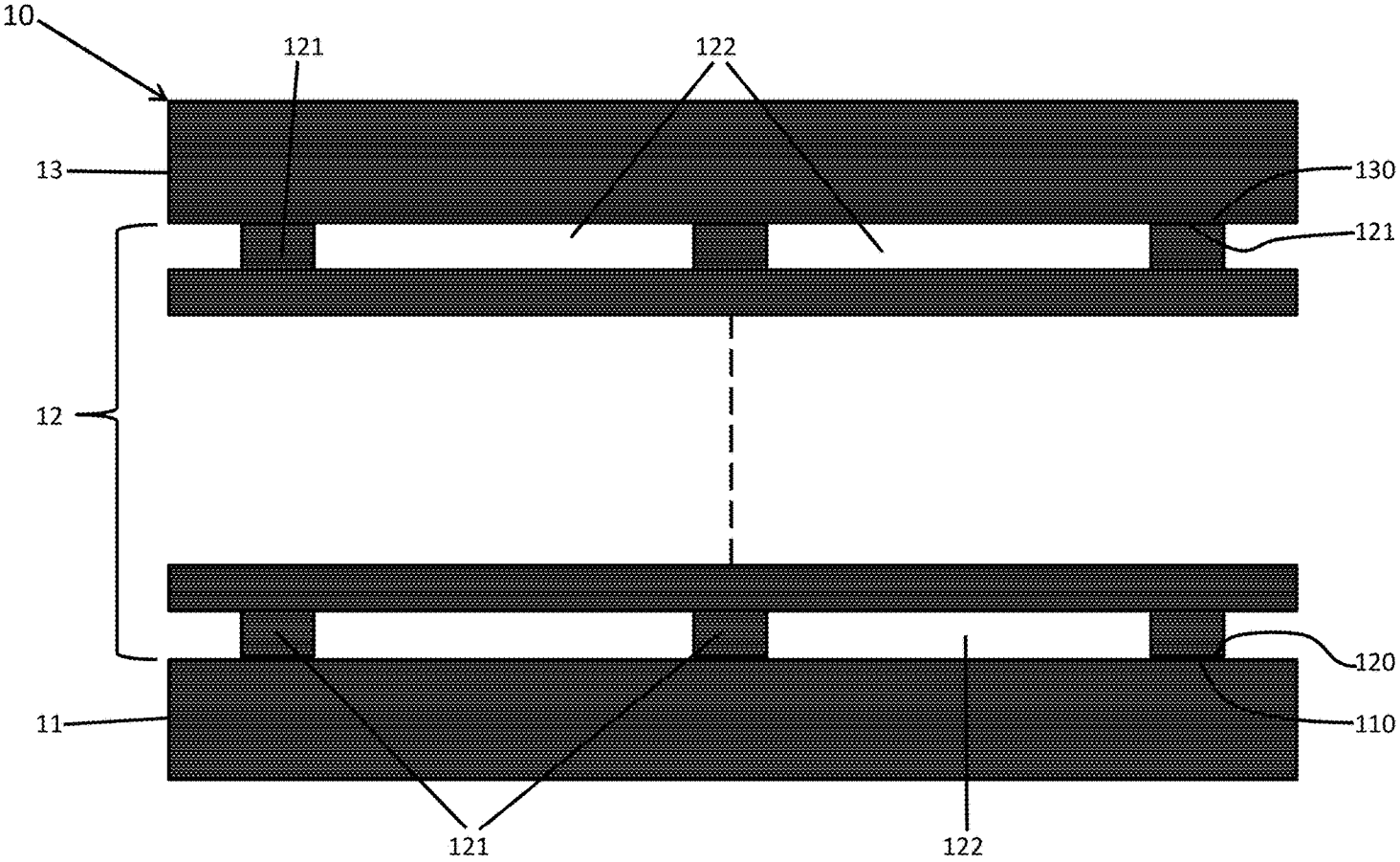
FIG. 2 is an enlarged side view of a radome sidewall in accordance with embodiments.
Figure 9:
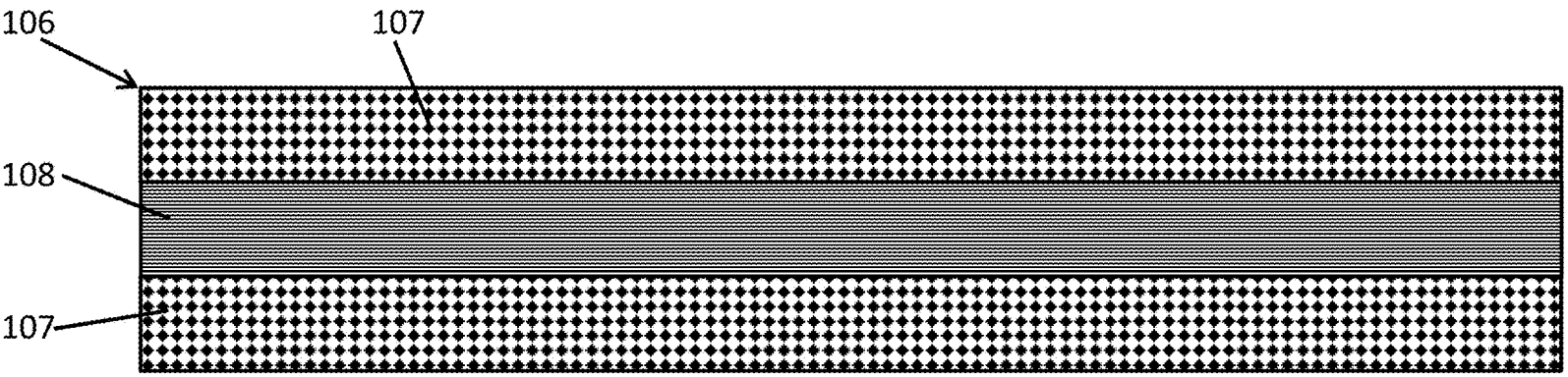
FIG. 9 is an enlarged side view of a radome sidewall in accordance with alternative embodiments.

Thus, with reference to FIG. 2, a monolithic, wideband, millimeter-wave radome 10 is provided with an A-sandwich type of structure (B-, C- or D-sandwich structure types may, of course, also be formed by similar processes as those described herein as shown in FIG. 9). The monolithic, wideband, millimeter-wave radome 10 includes a first single and solid layer 11, a single lattice layer 12 and a second single and solid layer 13. The first single and solid layer 11 has a relatively high dielectric constant and is formed of a single material by way of FDM, SLS, SLA or another similar additive manufacturing process (e.g., the single material may be at least one of Polyether Ether Ketone (PEEK), Polyether Ketone Ketone (PEKK), acrylonitrile butadiene styrene, Nylon and Ultem™ 9085 or a similarly FDM/AM suitable material).

The single lattice layer 12 has a relatively low dielectric constant and is formed of the single material. The single lattice layer 12 is disposed on an uppermost surface 110 of the first single and solid layer 11 such that a lowermost surface 120 of the single lattice layer 12 is non-adhesively bonded to the uppermost surface 110. The second single and solid layer 13 has a relatively high dielectric constant and is formed of the single material. The second single and solid layer 13 is disposed on an uppermost surface 121 of the single lattice layer 12 such that a lowermost surface 130 of the second single and solid layer 13 is non-adhesively bonded to the uppermost surface 121.

As used herein, the term "non-adhesively bonded" refers to any bonding between a layer of the single material and another layer of the single material that is generated by FDM or another suitable additive manufacturing process.

The single lattice layer 12 includes solid regions 121 and void regions 122 that are interspersed among the solid regions 121. The void regions 122 are formed from selective omission of the single material during buildup processes of the single lattice layer 12 such that the single lattice layer 12 has an effective dielectric constant $\in_{eff}$ approximated by:

$$\in_{eff}=f\in_R+(1-f)\in_{void},$$

where $\in_R$ is a dielectric constant of the first and second single and solid layers 11 and 13, $\in_{void}$ is a dielectric constant of the void regions and f is a volume fill fraction of the single material in the single lattice layer 12.

The monolithic, wideband, millimeter-wave radome 10 of FIG. 2 may be fabricated in a layer-by-layer pattern from one side to the other and vice versa. As noted above, the first and second single and solid layers 11 and 13 are laid down as solid layers of the single material. The low-dielectric single lattice layer 12 is realized by selective omission of the single material during buildup processes. In accordance with embodiments, the single lattice layer 12 can thus assume the form of a sparse three-dimensional lattice of beams, spars and/or partitions whose volume fill-factor is chosen to realize the desired effective dielectric constant and whose geometric layout is designed to maximize mechanical strength subject to the fill-factor constraint.

That is, if the single material has the dielectric constant $\in_R$ and the void regions have the dielectric constant $\in_{void}$ (typically $\in_{void}=1$ for air-filled voids), the desired dielectric constant for the lattice $\in_{eff}$ can be approximated by a weighted average of the two dielectric constants;

$$\begin{aligned}\varepsilon_{eff} &\cong \frac{V_{fill}}{V_{tot}}\varepsilon_R + \frac{V_{tot}-V_{fill}}{V_{tot}}\varepsilon_{void}\\ &= f\varepsilon_R + (1-f)\varepsilon_{void},\end{aligned}$$

where f is the volume fill fraction of the single material within the single lattice layer 12. Therefore, in an exemplary case, if $\in_R=3$, $\in_{void}=1$ and $\in_{lattice}=1.25$ is desired, the volume fill fraction of the single material within the single lattice layer 12 is 0.125. In other words, the single lattice layer 12 has the desired effective dielectric constant $\in_{lattice}$ of 1.25 by the selective omission of 87.5% of the single material during the buildup of the single lattice layer 12.

Figure 3A:
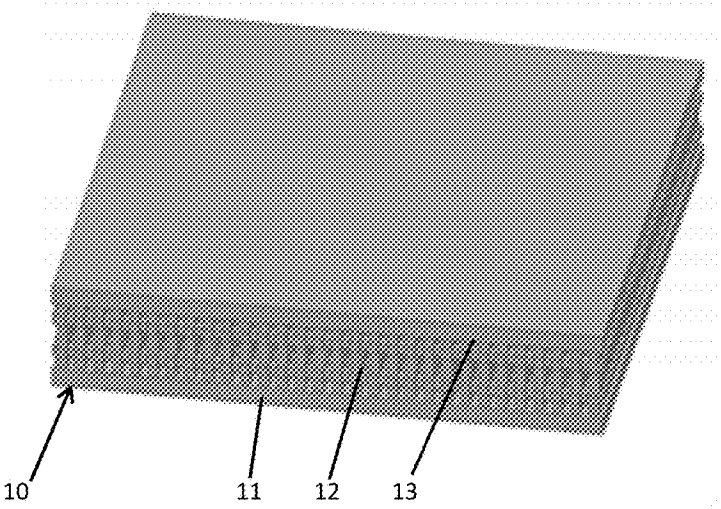
FIG. 3A is a perspective view of a radome including a rectangular lattice structure.
Figure 3B:
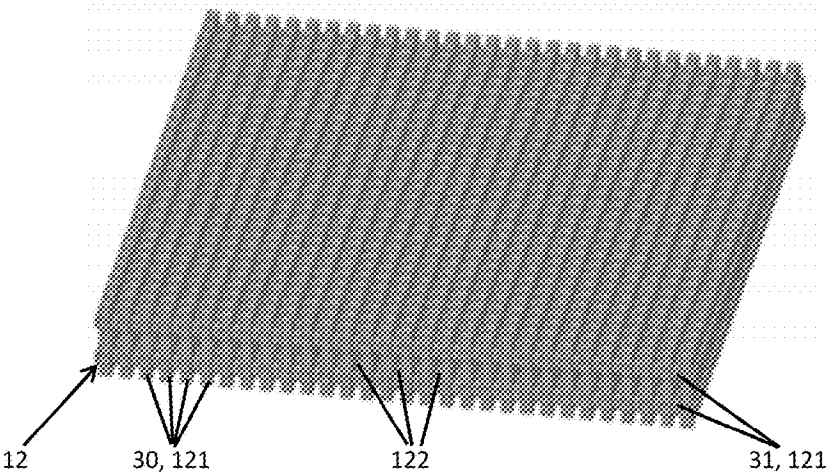
FIG. 3B is a perspective view of the rectangular lattice structure of the radome of FIG. 3A.

With reference to FIGS. 3A and 3B, the radome 10 of FIG. 2 may be formed such that the formation of the single lattice layer 12 is realized with a rectangular lattice structure. In accordance with embodiments, each of the first and second single and solid layers 11 and 13 may be about 47 mils thick with the rectangular-lattice single lattice layer 12 being about 180 mils thick to yield a total thickness of 0.274".

The rectangular-lattice structure of the single lattice layer 12 may be constructed using the formation of square beams that are about 25 mils on a side (rectangular and annular beams may also be used). The square beams include vertically oriented beams 30 and horizontally oriented beams 31 that cooperatively form the solid regions 121. The vertically oriented beams 20 may be arranged on their respective sides in a non-abutting front-to-back array. The horizontally oriented beams 31 are supported along the vertical lengths of the vertically oriented beams 30 at vertical distances from one another. As such, the spaces between adjacent vertically oriented beams 30 and proximal horizontally oriented beams 31 define the void regions 122.

By way of clarity, FIG. 3A shows a 1.35" square sample of a complete radome 10 and FIG. 3B shows the same structure with the first and second single solid layers 11 and 13 removed to reveal the rectangular lattice structure of the single lattice layer 12. The calculated insertion loss for the radome 10 when fabricated from Ultem 9085 may be plotted, for example, for two orthogonal incident polarizations as functions of frequency and angle of incidence whereupon it is seen that insertion loss of the radome 10 remains well below about 0.5 dB for all frequencies until the angle of incidence exceeds about 20°.

Of course, it is to be understood that many lattice geometries are possible for the single lattice layer 12 besides the rectangular lattice illustrated in FIGS. 3A and 3B. These include, but are not limited to, the woodpile lattice structure of FIGS. 4A and 4B and the diamond lattice structure of FIGS. 5A and 5B.

Figure 4B:
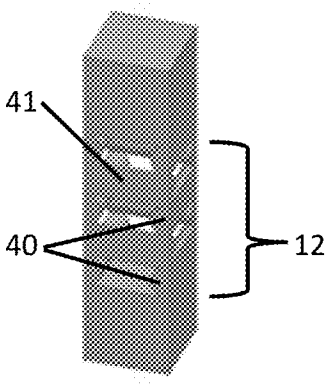
FIG. 4B is an enlarged perspective view of the "woodpile" lattice structure of the radome of FIG. 4A.
Figure 4A:
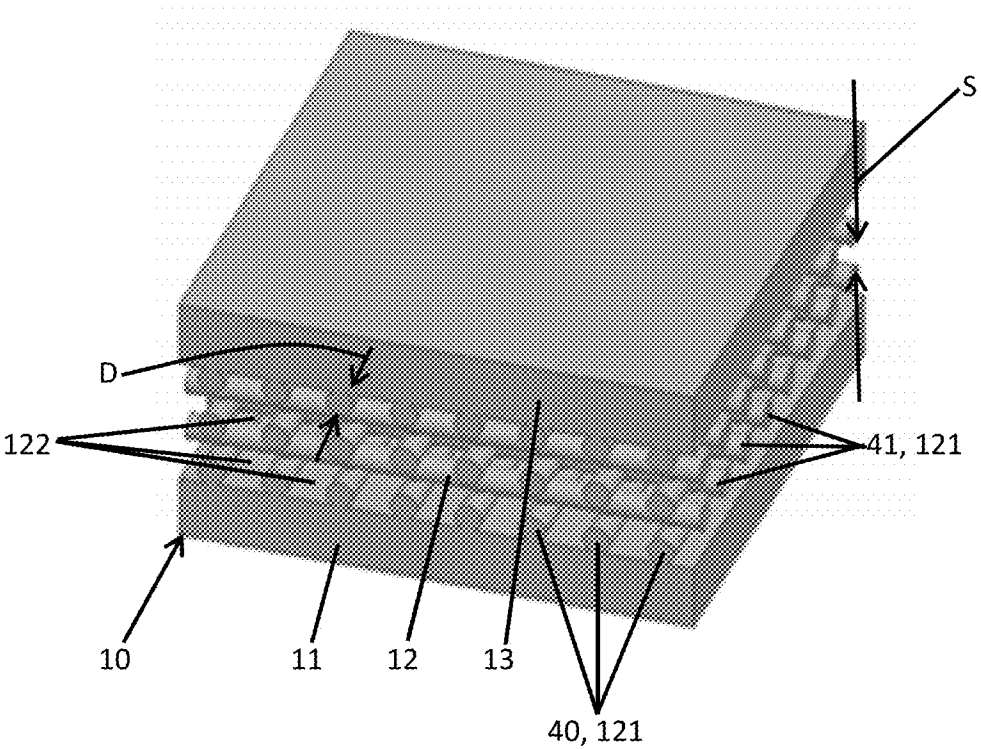
FIG. 4A is a perspective view of a radome including a "woodpile" lattice structure.

As shown in FIGS. 4A and 4B, the "woodpile" lattice structure includes first cylindrical beams 40 (angular beams may also be used) that are arranged in a non-abutting side-by-side pattern to extend in a first direction and second cylindrical beams 41 (again, angular beams may also be used) that are similarly arranged in a non-abutting side-by-side pattern to extend in a second direction. The first and second directions may be transversely oriented with respect to each other and, in some cases, may be perpendicular. The first cylindrical beams 40 and the second cylindrical beams 41 cooperatively form the solid regions 121 and the spaces between adjacent first cylindrical beams 40 and proximal adjacent second cylindrical beams 41 define the void regions 122.

With such construction, if a diameter of the first and second cylindrical beams 40 and 41 is D and the beam-to-beam separation in each sub-layer of first and second cylindrical beams 40 and 41 is S, the volume fill factor of the "woodpile" lattice structure is:

$$f = \frac{\pi D}{4S}.$$

Thus, if the single material used to form the "woodpile" lattice structure is Ultem™ 9085 or another similar low-loss dielectric for which $\in_R$=2.49 and tan δ=0.006, an effective lattice dielectric constant of $\in_{lattice}$=1.5 requires a fill factor of approximately 33% (f=0.33). Therefore, if the diameter of the first and second cylindrical beams 40 and 41 is 20 mils, the required beam-to-beam separation is S=47 mils. Exemplary thicknesses for the first and second single and solid layers 11 and 13 of 48 and 94 mils, respectively, may then be chosen to minimize insertion losses across a 71-86 GHz operating band. The calculated insertion loss for the radome 10 in the embodiment of FIGS. 4A and 4B may be plotted, for example, for two orthogonal incident polarizations as functions of frequency and angle of incidence whereupon it is seen that insertion loss of the radome 10 remains well below about 0.71 dB for all frequencies between 0° and 30° and is generally less than 0.4 dB.

Figure 5B:
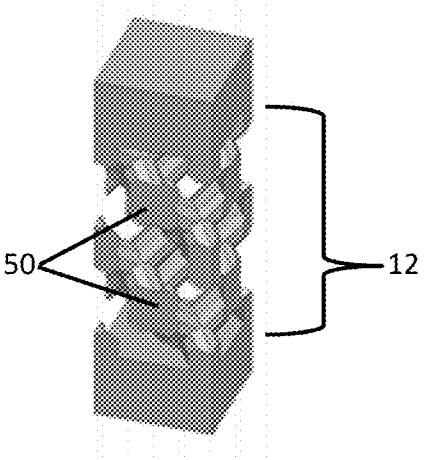
FIG. 5B is an enlarged perspective view of the diamond lattice structure of the radome of FIG. 5A.
Figure 5A:
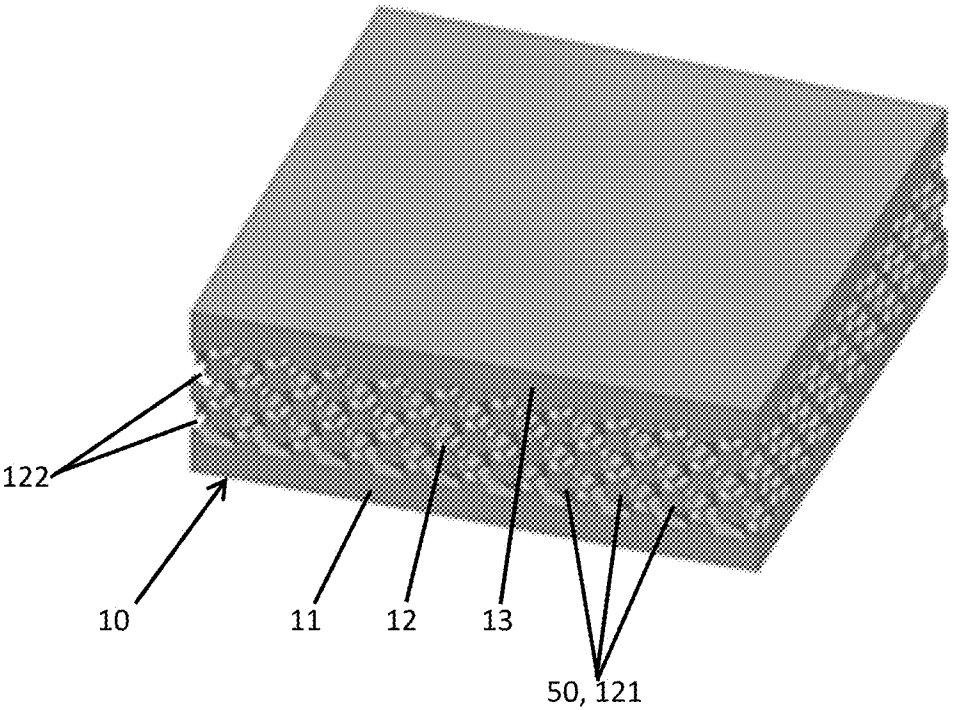
FIG. 5A is a perspective view of a radome including a diamond lattice structure.

As shown in FIGS. 5A and 5B, the diamond lattice structure includes a plurality of rod elements 50 that are arranged in a continuous diamond lattice pattern. The rod elements 50 cooperatively form the solid regions 121 and the spaces between the orthogonal rod elements 50 define the void regions 122. With this construction, for an exemplary case in which the first and second single solid layers 11 and 13 are 46 mils thick and the diamond-lattice structure of the single lattice layer 12 is 162 mils thick for a total radome thickness of 0.254" and in which the orthogonal rod elements 25 mils in diameter, a single unit cell 51 of the diamond lattice structure measures 81 mils on a side. Calculated insertion loss for this radome embodiment again remains less than 0.5 dB for incident angles less than 20°.

While the radome 10 described above is provided as an A-sandwich type of structure it is to be understood that other embodiments exist. In particular, it is to be understood that the radome 10 described above can be formed with a B-sandwich type of structure and/or with a flat or complex geometry such as the geometry of the radome 1 of FIG. 1. Moreover, in these or other cases, the structure of the radome 10 can be modified beyond what is described above.

Figure 6:
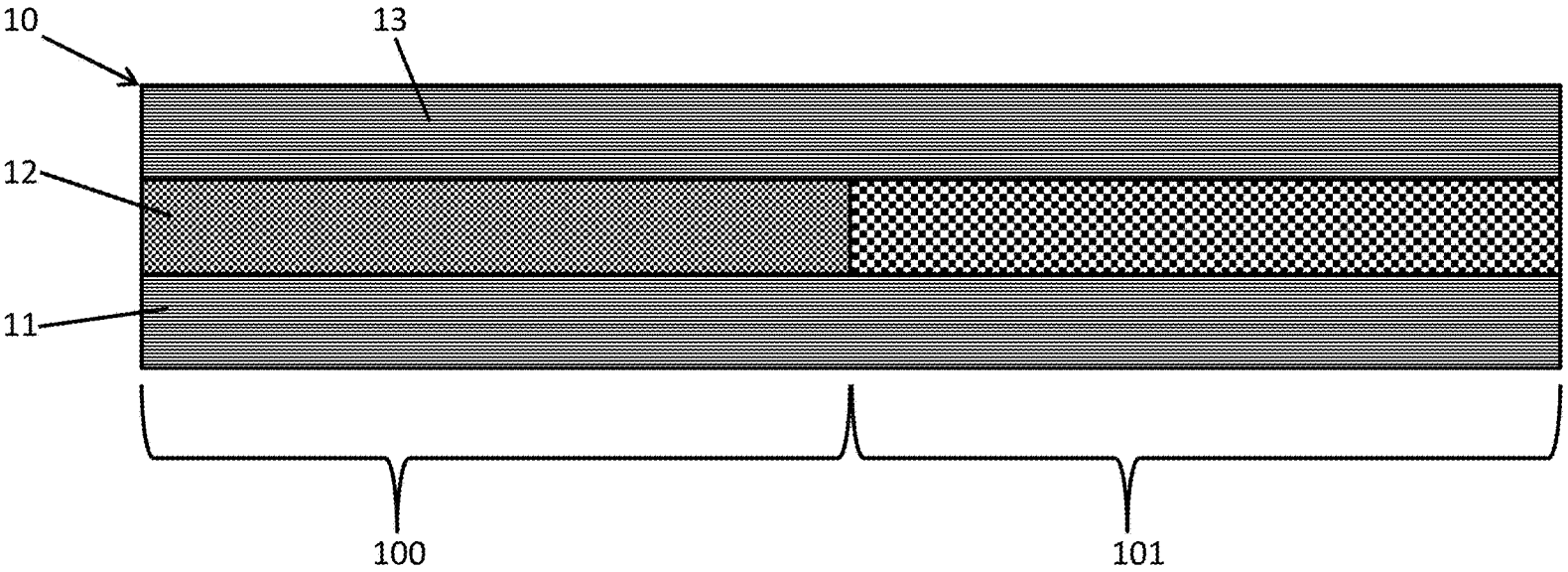
FIG. 6 is an enlarged side view of a radome sidewall in accordance with alternative embodiments.
Figure 7:
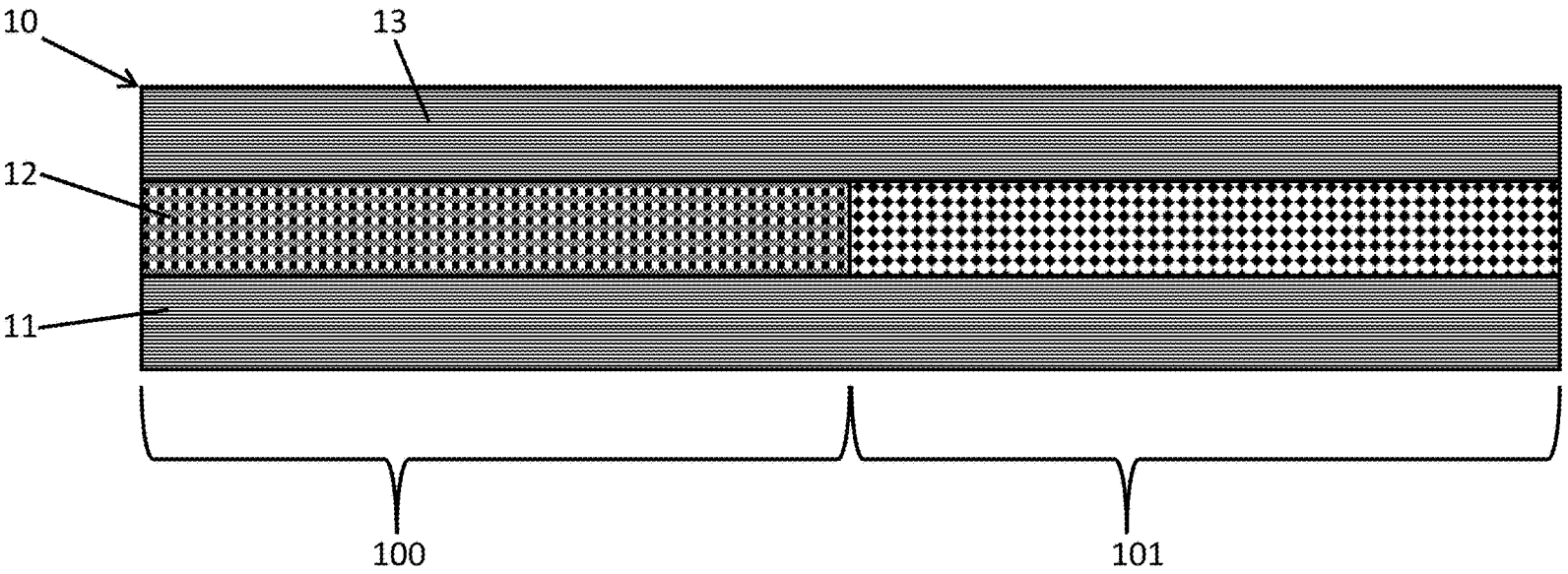
FIG. 7 is an enlarged side view of a radome sidewall in accordance with alternative embodiments.

For example, with reference to FIGS. 6 and 7, the single lattice layer 12 of the radome 10 may have a hybridized structure in which first and second lateral portions 100 and 101 of the radome 10 have a same lattice geometry or structure with differing lattice parameters, such as differing beam diameters or spacings (see FIG. 6) or different single lattice layer 12 structures (e.g., the first lateral portion has a "woodpile" lattice structure and the second lateral portion 101 has a diamond lattice structure) to achieve different localized performance characteristics.

Figure 8:
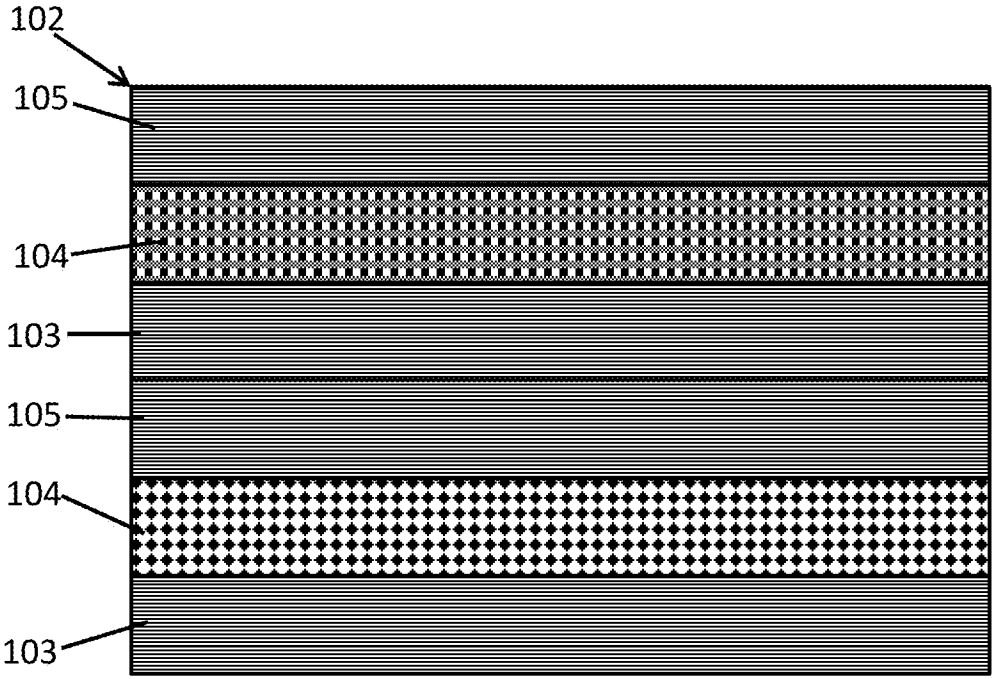
FIG. 8 is an enlarged side view of a radome sidewall in accordance with further alternative embodiments.

As another example, with reference to FIG. 8, a monolithic, wideband, millimeter-wave radome 102 is formed by way of similar processes as those described above but includes multiple first single and solid layers 103, multiple single lattice layers 104 and multiple second single and solid layers 105. The multiple single lattice layers 104 are disposed on respective uppermost surfaces of corresponding ones of the multiple first single and solid layers 103 and the multiple second single and solid layers 105 are disposed on respective uppermost surfaces of corresponding ones of the multiple single lattice layers 104.

As yet another example, with reference to FIG. 9, a monolithic, wideband, millimeter-wave radome 106 may be formed by way of similar processes as those described above but includes multiple (e.g., first and second) lattice layers 107 formed on opposite exterior surfaces of a solid layer 108 in a B-sandwich type of configuration.

While a material, such as Ultem 9085 can be used for a low- to moderate-speed nose-mounted radome or for a window/radome for a sensor or telemetry/communication antenna on a different part of the missile body where the mechanical/thermal environment is more benign, other materials may be used for a nose-mounted supersonic missile radome. Furthermore, this technology can be extended to lower frequencies for use with a single wideband sensor or as a common window for use with multiple sensors having a wide range of operating frequencies. For example, there may be wideband performance potential of this technology for frequencies below W-band (e.g., for frequencies between 100 MHz and 40 GHz) where a rectangular lattice structure of the single lattice layer 12 include 40 mil by 40 mil beams with a lattice period of 120 mils to realize a low-dielectric lattice with $\in_{lattice}$=1.5. Insertion loss for this structure may be less than 1 dB from very low frequencies to 40 GHz over a wide range of incident angles.

Any one or more of the radomes described above may be provided for use as an affordable millimeter-wave radome for low-speed aircraft (e.g., UAVs). Such radomes would have low reflection and transmission losses over a wide bandwidth and adequate mechanical strength for the expected flight regimes of the low-speed aircraft.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts and equivalents of all means or step plus function elements in the claims below are intended to include any structure, material or act for performing the function in combination with other claimed elements as claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While embodiments have been described, it will be understood that those skilled in the art, both now and in the future, may make various improvements and enhancements which fall within the scope of the claims which follow. These claims should be construed to maintain the proper protection for the invention first described.

What is claimed is:

1. A monolithic, wideband, millimeter-wave radome, comprising:

a solid layer formed of a single material; and a lattice layer formed of the single material and disposed on an exterior surface of the solid layer, wherein:

the lattice layer comprises multiple layers respectively comprising solid regions formed of the single material and void regions that are interspersed with the solid regions and are formed from selective omission of the single material during lattice layer buildup, each one of the multiple layers has a first lattice arrangement and is adjacent to at least another one of the multiple layers having a second lattice arrangement differing from the first lattice arrangement, and there is nothing between each one of the multiple layers having the first lattice arrangement and the adjacent one of the multiple layers having the second lattice arrangement.

2. The monolithic, wideband, millimeter-wave radome according to claim 1, wherein the single material comprises at least one of Polyether Ether Ketone (PEEK), Polyether Ketone Ketone (PEKK), acrylonitrile butadiene styrene, Nylon and Ultem™ 9085.

3. The monolithic, wideband, millimeter-wave radome according to claim 1, wherein the lattice layer comprises at least one of a rectangular lattice, a woodpile lattice and a diamond lattice.

4. The monolithic, wideband, millimeter-wave radome according to claim 1, wherein the lattice layer comprises first and second lattice layers formed on opposite exterior surfaces of the solid layer.

5. A monolithic, wideband, millimeter-wave radome, comprising:

a solid layer formed of a single material; and a lattice layer formed of the single material and disposed on an exterior surface of the solid layer, wherein the lattice layer comprises void regions formed from selective omission of the single material during lattice layer buildup, and the lattice layer has a dielectric constant $\in_{eff}$ in which:

$$\in_{eff}=f\in_R+(1-f)\in_{void},$$

where $\in_R$ is a dielectric constant of the solid layer, $\in_{void}$ is a dielectric constant of the void regions and f is a volume fill fraction of the single material in the lattice layer.

6. A monolithic, wideband, millimeter-wave radome, comprising:

multiple solid layers formed of a single material; and multiple lattice layers formed of the single material and disposed on respective exterior surfaces of corresponding ones of the multiple solid layers, wherein:

each of the multiple lattice layers comprises multiple layers respectively comprising solid regions formed of the single material and void regions that are interspersed with the solid regions and are formed from selective omission of the single material during lattice layer buildups, and within each of the multiple lattice layers, each one of the multiple layers has a first lattice arrangement and is adjacent to at least another one of the multiple layers having a second lattice arrangement differing from the first lattice arrangement, and there is nothing between each one of the multiple layers having the first lattice arrangement and the adjacent one of the multiple layers having the second lattice arrangement.

7. The monolithic, wideband, millimeter-wave radome according to claim 6, wherein the single material comprises at least one of Polyether Ether Ketone (PEEK), Polyether Ketone Ketone (PEKK), acrylonitrile butadiene styrene, Nylon and Ultem™ 9085.

8. The monolithic, wideband, millimeter-wave radome according to claim 6, wherein at least one of the multiple lattice layers comprises at least one of a rectangular lattice, a woodpile lattice and a diamond lattice.

9. The monolithic, wideband, millimeter-wave radome according to claim 6, wherein at least first and second ones of the multiple lattice layers are formed on opposite exterior surfaces of one of the solid layers.

10. A monolithic, wideband, millimeter-wave radome, comprising:

multiple solid layers formed of a single material; and multiple lattice layers formed of the single material and disposed on respective exterior surfaces of corresponding ones of the multiple solid layers, wherein each of the multiple lattice layers comprises void regions formed from selective omission of the single material during lattice layer buildups, and the multiple lattice layers each have a dielectric constant $\in_{eff}$ in which:

$$\in_{eff}=f\in_R+(1-f)\in_{void},$$

where $\in_R$ is a dielectric constant of the multiple solid layers, $\in_{void}$ is a dielectric constant of the void regions and f is a volume fill fraction of the single material in the multiple lattice layers.

11. A monolithic, wideband, millimeter-wave radome fabrication method, comprising:

laying down a single material in a layer-by-layer and side-to-side pattern to form a solid layer; and laying down the single material in a layer-by-layer and side-to-side pattern to form a lattice layer on an exterior surface of the solid layer, wherein:

the laying down of the single material to form the lattice layer comprises selectively omitting the single material during buildup of the lattice layer to develop multiple layers respectively comprising solid regions formed of the single material and void regions that are interspersed with the solid regions and are formed from a halting of the laying down of the single material in only locations of the void regions and thus a selective omission of the single material during lattice layer buildup, and each one of the multiple layers has a first lattice arrangement and is adjacent to at least another one of the multiple layers having a second lattice arrangement differing from the first lattice arrangement with nothing between each one of the multiple layers having the first lattice arrangement and the adjacent one of the multiple layers having the second lattice arrangement.

12. The method according to claim 11, wherein the laying down of the single material comprises one of fused deposition modeling (FDM), selective laser sintering (SLS) and stereolithography (SLA).

13. The method according to claim 11, wherein the single material comprises at least one of Polyether Ether Ketone (PEEK), Polyether Ketone Ketone (PEKK), acrylonitrile butadiene styrene, Nylon and Ultem™ 9085.

14. The method according to claim 11, wherein the laying down of the single material to form the lattice layer comprises forming a rectangular lattice.

15. The method according to claim 11, wherein the laying down of the single material to form the lattice layer comprises forming a woodpile lattice.

16. The method according to claim 11, wherein the laying down of the single material to form the lattice layer comprises forming a diamond lattice.

17. The method according to claim 13, wherein the laying down of the single material forms a B-sandwich configuration.

18. The method according to claim 13, further comprising:

laying down the single material in the layer-by-layer and side-to-side pattern to form multiple solid layers; and laying down the single material in the layer-by-layer and side-to-side pattern to form multiple lattice layers on respective exterior surfaces of corresponding ones of the multiple solid layers, wherein the laying down of the single material to form the multiple lattice layers comprises a halting of the laying down of the single material in only locations of void regions to be formed and thus selectively omitting the single material during buildup of the multiple lattice layers to develop the void regions therein.

19. The method according to claim 13, wherein the laying down of the single material forms multiple B-sandwich configurations.

20. A monolithic, wideband, millimeter-wave radome fabrication method, comprising:

laying down a single material in a layer-by-layer and side-to-side pattern to form a solid layer; and laying down the single material in a layer-by-layer and side-to-side pattern to form a lattice layer on an exterior surface of the solid layer, wherein the laying down of the single material to form the lattice layer comprises selectively omitting the single material during buildup of the lattice layer to develop void regions, and the selective omitting of the single material achieves a dielectric constant $\in_{eff}$ of the lattice layer in which:

$$\in_{eff}=f\in_{R}+(1-f)\in_{void},$$

where $\in_{R}$ is a dielectric constant of the solid layer, $\in_{void}$ is a dielectric constant of the void regions and f is a volume fill fraction of the single material in the lattice layer.

* * * * *